US009596908B2

(12) United States Patent
Hortnagl

(10) Patent No.: US 9,596,908 B2
(45) Date of Patent: Mar. 21, 2017

(54) BELT BUCKLE

(75) Inventor: Andreas Hortnagl, Fulpmes (AT)

(73) Assignee: ABA Hörtnagl GmbH, Fulpmes (AT)

( * ) Notice: Subject to any disclaimer, the term of this patent is extended or adjusted under 35 U.S.C. 154(b) by 298 days.

(21) Appl. No.: 14/122,316

(22) PCT Filed: May 23, 2012

(86) PCT No.: PCT/AT2012/000144
§ 371 (c)(1),
(2), (4) Date: Nov. 26, 2013

(87) PCT Pub. No.: WO2012/162712
PCT Pub. Date: Dec. 6, 2012

(65) Prior Publication Data

US 2014/0082902 A1 Mar. 27, 2014

(30) Foreign Application Priority Data

May 27, 2011 (AT) ..... A 783/2011

(51) Int. Cl.
*A44B 11/25* (2006.01)
*A44B 11/10* (2006.01)
*A44B 11/26* (2006.01)

(52) U.S. Cl.
CPC ..... *A44B 11/2553* (2013.01); *A44B 11/10* (2013.01); *A44B 11/2519* (2013.01); *A44B 11/2546* (2013.01); *A44B 11/266* (2013.01); *Y10T 24/45785* (2015.01)

(58) Field of Classification Search
CPC ... A44B 11/2553; A44B 11/266; A44B 11/10; A44B 11/2519; A44B 11/2546; A44B 11/06; A44B 11/12; A44B 11/16; A44B 11/2526; Y10T 24/45785; Y10T 24/4012; Y10T 24/4014; Y10T 24/4016; Y10T 24/4072; Y10T 24/4077; Y10T 24/4086; Y10T 24/4088; Y10T 24/4093
USPC ..... 24/614–615, 171
See application file for complete search history.

(56) References Cited

U.S. PATENT DOCUMENTS

| | | | | |
|---|---|---|---|---|
| 1,821,839 A | | 9/1931 | Kerngood | |
| 3,169,291 A | * | 2/1965 | Stacheri | A44B 11/10 24/196 |
| 3,696,471 A | * | 10/1972 | Mermelstein | A44B 11/12 24/193 |
| 3,992,756 A | | 11/1976 | Stafstrom | |
| 4,074,401 A | | 2/1978 | Spinosa et al. | |
| 4,158,907 A | | 6/1979 | Spinosa et al. | |

(Continued)

FOREIGN PATENT DOCUMENTS

| | | |
|---|---|---|
| AT | 413786 | 6/2006 |
| AT | 506214 | 7/2009 |

(Continued)

OTHER PUBLICATIONS pp. 1-7 from www.charly-produkte.de—PL-Hook Gurtschloss, dated Nov. 24, 2011.

*Primary Examiner* — Abigail Morrell
(74) *Attorney, Agent, or Firm* — Volpe and Koenig, P.C.

(57) ABSTRACT

A belt buckle (1) with at least one belt-fastening element (2) for at least one belt (35) and with at least one fastening component (4, 5) which is prestressed by at least one elastic prestressing element (3), wherein the prestressing element (3) is integrally formed on the fastening component (4, 5).

18 Claims, 4 Drawing Sheets

(56) References Cited

U.S. PATENT DOCUMENTS

| | | | | |
|---|---|---|---|---|
| 4,408,373 | A | 10/1983 | Miskowicz | |
| 5,170,539 | A | 12/1992 | Lundstedt et al. | |
| 5,471,714 | A * | 12/1995 | Olson | A44B 11/10 24/171 |
| 5,561,891 | A | 10/1996 | Hsieh | |
| 5,604,964 | A | 2/1997 | Aoshima | |
| 5,651,166 | A | 7/1997 | Lundstedt | |
| 5,784,767 | A | 7/1998 | Doty, Jr. | |
| 5,893,199 | A | 4/1999 | Anscher | |
| 6,023,820 | A | 2/2000 | Fair | |
| 6,463,640 | B1 * | 10/2002 | Toth | 24/648 |
| 7,353,573 | B2 * | 4/2008 | Anscher | A44B 11/006 24/170 |
| 8,561,268 | B2 | 10/2013 | Hortnagl | |
| 2003/0197415 | A1 | 10/2003 | Dingman | |
| 2004/0078943 | A1 | 4/2004 | Hede et al. | |
| 2006/0101627 | A1 | 5/2006 | Ida | |
| 2007/0186394 | A1 | 8/2007 | Hsiao | |
| 2009/0044383 | A1 | 2/2009 | Gastaldi | |
| 2010/0071173 | A1 | 3/2010 | Hortnagl | |
| 2014/0082902 | A1 | 3/2014 | Hortnagl | |

FOREIGN PATENT DOCUMENTS

| | | |
|---|---|---|
| CA | 2856603 | 6/2013 |
| CH | 674302 | 5/1990 |
| DE | 1557461 | 4/1970 |
| DE | 69315136 | 3/1998 |
| DE | 60310029 | 6/2007 |
| EP | 2191739 | 6/2010 |
| GB | 1066740 | 4/1967 |
| WO | 03049107 | 7/2003 |
| WO | 03059107 | 7/2003 |
| WO | 2013078486 | 6/2013 |

* cited by examiner

BELT BUCKLE

BACKGROUND

The present invention relates to a belt buckle having at least one belt fastening element for at least one belt and having at least one fastening component which is prestressed by means of at least one elastic prestressing element.

Belt buckles of this generic type are known, for example, from AT 506 214 B1 and EP 2 191 739 A2. In the Austrian patent mentioned first, a two-part belt buckle having a male buckle part and a female buckle part is shown. In the locked position, the male buckle part is locked in the female buckle part by means of fastening components which are configured as locking levers. Helical springs which prestress the locking levers in the direction of their locked position serve as elastic prestressing elements.

The European application which is mentioned second shows both belt buckles having a male and a female buckle part and belt buckles which consist of a single buckle part. FIGS. 9 to 13 of said European application disclose a fastening component which is configured as a clamping web for clamping a belt fixedly, which fastening component is prestressed in the direction of its clamping position by elastic prestressing elements which are configured in the form of helical springs.

SUMMARY

It is an object of the invention to simplify the construction of belt buckles of this generic type.

To this end, it is provided that the prestressing element is formed integrally on the fastening component.

In other words, it is therefore provided according to the invention that the prestressing element and the locking element are manufactured continuously as one part.

The number of parts is reduced as a result of the integral arrangement of the prestressing element on the fastening component. Moreover, the assembly of the belt buckle is also simplified.

It is particularly inexpensive and simple in terms of production to configure the prestressing element and the fastening component as one continuous plastic part. For example, it is possible in this context to produce prestressing elements and fastening components as an integral plastic injection-molded part.

According to the invention, in principle different types of prestressing elements can be provided integrally on different types of fastening components of the belt buckle. In this context, variants which are particularly simple to produce provide that the prestressing element is configured as a spring tongue which protrudes from the fastening component at least in the unloaded state.

Preferred variants provide that the belt buckle comprises plastic or is composed completely thereof. However, it is also to be noted that belt buckles according to the invention can also be produced from other materials. Thus, for example, they can be belt buckles made from metal and plastic or alternatively pure metal buckles.

For the sake of completeness, it is noted that a belt buckle is generally a component which serves to fasten a belt or a strap to an object and, in particular, to another belt or strap. Here, the belt or the strap is fastened to the belt buckle by means of the belt fastening element. Both the type of belt buckle and the type of belt fastening element can be of very different configuration. They can be belt buckles which are of two-piece or multiple-piece construction, a first part of the belt buckle having a first belt fastening element for a first belt and at least one further buckle part having at least one further belt fastening element for at least one further belt, it being possible for the buckle parts to be fastened releasably to one another or to be locked to one another. In embodiments of this type, the fastening component or components can be configured as locking levers, by way of which the buckle parts can be locked or fastened releasably to one another.

Particularly preferred embodiments provide that the belt buckle has at least one male buckle part and at least one female buckle part, it being possible for the male buckle part and the female buckle part to be disconnected from one another and to be locked in one another or on one another by means of the fastening component which is configured as a locking lever or by means of one or more of the fastening components which are configured as locking levers.

In order to provide a belt buckle which is very stable, can be used even in the case of a great action of force from the outside and nevertheless can be of slim design, preferred embodiments of the invention provide in this context that, in the locked position, in which the male buckle part and the female buckle part are locked in one another or on one another, at least one, preferably each, of the fastening components which are configured as locking levers is subjected to a compressive load, preferably exclusively, in the case of a tensile load in at least one disconnecting direction, in which the male buckle part and the female buckle part can be disconnected from one another. Here, the disconnecting directions are the directions in which the male and/or female buckle part are/is pulled off from the respective other buckle part, in order to disconnect said two buckle parts from one another. If substantially or preferably exclusively only compressive forces occur on the locking lever in the locked position, said locking lever can absorb high loads without having to be of particularly large design. It can be provided, for example, that at least one, preferably each, of the fastening components which are configured as locking levers is mounted such that it can be pivoted about a pivot pin and, in the locked position, in which the male buckle part and the female buckle part are locked in one another or on one another, engages behind a locking shoulder of a push-in anchor of the male buckle part, wherein the locking shoulder is to be moved past the pivot pin during the disconnection of the male buckle part from the female buckle part. This achieves a situation where the locking lever is subjected only to a compressive load when it is situated in the locked position and is pulled in the respective disconnecting direction on at least one of the buckle parts.

However, the invention can also be implemented in the case of belt buckles which are formed only of one buckle part, preferably with one or more belt fastening elements.

It is also possible that the fastening component or at least one of the fastening components is a clamping web, which preferably forms a constituent part of the belt fastening element, for fixedly clamping the belt which is guided around the clamping web.

In order to also achieve a high strength of the belt fastening element here with elements which are of as slim design as possible, preferred embodiments of the belt buckle according to the invention provide that, for mounting on the belt buckle, the fastening component or at least one of the fastening components can be pivoted onto said belt buckle, preferably so as to latch in the belt buckle. A corresponding method for mounting a fastening component of this type provides that, for mounting on the belt buckle, the fastening component or at least one of the fastening components is pivoted onto said belt buckle, preferably so as to latch in the belt buckle.

It is thus possible, for example, that the fastening component has guide webs, by way of which it is mounted in guide web receptacles of the belt fastening element such that it can be displaced, preferably linearly, the guide web receptacles and/or the guide webs in each case having, as viewed in a section, a cross section which is widened on one side, preferably in a wedge-shaped manner. The widened cross section of the guide web receptacles and/or guide webs permits the pivoting movement during pivoting of the fastening component which is configured as a clamping web. It is particularly favorable if the widened cross section is of wedge-shaped configuration.

As a result of the possibility of mounting the fastening component which is configured as a clamping web on the belt buckle by means of being pivoted onto it, both the clamping web itself and the opposing web of the belt fastening element, which opposing web interacts with said clamping web, can be of relatively solid and strong configuration, without this immediately leading to a particularly weighty and/or thick embodiment of the entire belt buckle.

In this context, it is also favorable if the cross section of the guide web receptacles is widened in a direction which points away from the region for guiding the belt around the clamping web and/or if the cross section of the guide webs is widened in a direction which points toward the region for guiding the belt around the clamping web.

In preferred embodiments, the guide webs protrude in a freely projecting manner in the form of pins, that is to say in a pin-like manner, from the region for guiding the belt around the clamping web. The region for guiding the belt around the clamping web or the fastening component is favorably arranged between the guide webs. In these variants, the guide web receptacles are then favorably arranged in such a way that the opposing web is not weakened by the guide web receptacles in the region in which it interacts with the belt and the clamping web.

For the sake of completeness, it is also noted that, in accordance with general language usage, a male buckle part is distinguished by the fact that it has a projection or a push-in anchor, by way of which it can be pushed into a corresponding receiving recess of a corresponding female buckle part and can be locked there.

The fastening component is as a rule mounted movably in some form. In this context, preferred embodiments provide that the fastening component is mounted such that it can be pivoted and/or displaced, preferably linearly. The prestressing element can be provided for prestressing the fastening component in the direction of its clamping position or its locked position.

If the fastening component is mounted such that it can be pivoted about a pivot pin, preferred embodiments of the invention provide that the pivot pin has at least one outer axle pin and at least one insertion part which is preferably configured as a pin or screw, the insertion part being inserted or being capable of being inserted into a recess in the axle pin. Slight spreading of the axle pin can occur during insertion of the insertion part into the corresponding recess in the axle pin, with the result that said axle pin is then fastened correspondingly. However, it is also possible, optionally in addition, for corresponding heads to be provided on the axle pin and also on the insertion part. If the axle pin has a corresponding head, it is favorable if the recess, into which the insertion part can be inserted, is open toward that side of the axle pin which is opposite the head of the axle pin.

If multiple-piece buckles having at least one female buckle part and at least one male buckle part are concerned, it is appropriate in the context of a flexible use capability if male and female buckle parts can be locked on one another or in one another by way of belt fastening elements of different width from one another. This makes it possible to connect belts and straps of different width to one another in a very flexible manner. In this context, a set according to the invention having at least one female buckle part and at least two male buckle parts provides that the male buckle parts have belt fastening elements of different width from one another for belts of different width from one another and are capable of being locked in or on the same female buckle part. However, a set of this type can also be equipped with at least one male buckle part and at least two female buckle parts, the female buckle parts having belt fastening elements of different width from one another for belts of different width from one another and being capable of being locked to the male buckle part. As a result of this, a system is provided, in which different buckle parts with belt fastening elements of different width for belts of different width can be combined with one another depending on requirements.

BRIEF DESCRIPTION OF THE DRAWINGS

Further details and features of preferred embodiments of the invention will be explained using the description of the figures, in which.

DETAILED DESCRIPTION OF THE PREFERRED EMBODIMENTS

Figure 1:
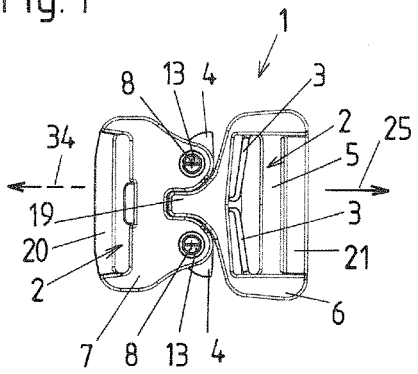
FIGS. 1 to 17 show different views with respect to a first exemplary embodiment according to the invention of a belt buckle.
Figure 2:
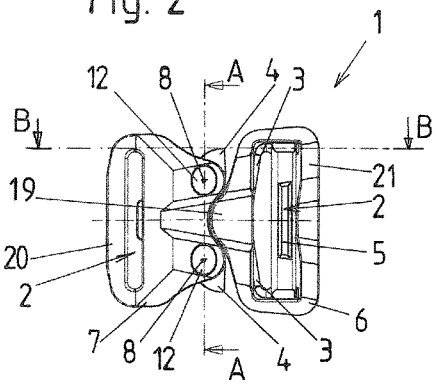

FIGS. 1 and 2 show a rear and a front view of a belt buckle 1 which is configured according to the invention and has a male buckle part 6 and a female buckle part 7. In FIGS. 1 and 2, the male buckle part 6 is inserted with its push-in anchor 14 completely into the corresponding receiving recess of the female buckle part 7 and is locked in this position by means of the fastening components 4 which are formed according to the invention and are configured as locking levers, with the result that the male buckle part 6 cannot be pulled out of the female buckle part 7. In order to fasten a strap or belt 35 (not shown here) to the belt buckle 1, both buckle parts 6 and 7 in each case have a belt fastening element 2. In the first exemplary embodiment which is shown, the belt fastening element 2 of the female buckle part is provided such that a belt 35 or a strap is pulled around the web 20 which is formed there and is then fixed, for example, by sewing. This is known per se and does not have to be explained further. In contrast, the belt fastening element 2 of the male buckle part 6 has a fastening component 5 according to the invention which is configured as a clamping web, around which the belt 35 or the strap can be wrapped, in order to fasten the belt 35 or the strap adjustably to the belt fastening element 2 and therefore to the male buckle part 6. The prestressing elements 3 which can be seen particularly clearly in FIG. 1 and are configured here in the form of spring tongues are provided for prestressing said fastening component 5 which is configured as a clamping web. According to the invention, they are arranged integrally on the fastening component 5 and press the latter into its clamping position, in which a belt 35 (not shown here) is pressed by the clamping web 5 against the fixed opposing web 21 of the male buckle part 6. In order to adjust the length of the belt 35 which is guided around the clamping web 5, the clamping web 5 is displaced, preferably linearly, counter to the prestress of the prestressing element 3 in the direction toward the push-in anchor 14, with the result that the belt 35 is no longer clamped between the clamping web 5 and the opposing web 21 and can be adjusted. When the belt adjustment has taken place, the prestressing element 3 pushes the clamping web 5 back into the clamping position again. In this clamping position, the clamping web 5 prevents undesired adjustment of the belt 35 even in the load-free state, in which the belt 35 is not under tensile stress.

Figure 8:
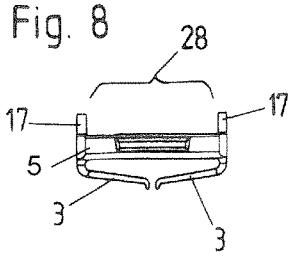

FIG. 8 shows the clamping web 5 which is used here with its integrally formed prestressing elements 3 in the manner of spring tongues and the guide webs 17, by way of which it is mounted in the male buckle part 6 or generally in the belt buckle 1 such that it can be displaced, preferably linearly. FIG. 8 also shows the region 28 of the clamping web for guiding the belt 35 around the clamping web 5. This region 28 is favorably arranged between the guide webs 17, as can also be seen in FIG. 8. The guide webs 17 are favorably configured such that they project freely like pins. This can also be seen clearly in FIGS. 8 and 9. As a result of this arrangement of the guide webs 17 at the edge with regard to the region 28, the opposing web 21 is not weakened by the guide web receptacles 26 in the region, in which it interacts with the region 28 of the clamping web 5 or with the belt 35. This makes it possible to realize a relatively stable solid embodiment in that region of the opposing web 21 which corresponds to the region 28, without it being necessary for the entire belt buckle 1 to be of particularly thick construction as a result.

Figure 9:
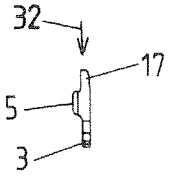
Figure 10:
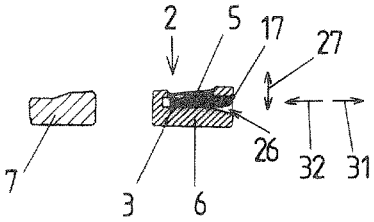

FIG. 9 shows a side view of said integral part including the clamping web 5, prestressing elements 3, and the guide webs 17. FIG. 10 shows a section along the sectional line BB which is illustrated in FIG. 2 and therefore shows the displaceable mounting of the clamping web 5 in the male buckle part 6. FIG. 10 shows the finally mounted state of the fastening component 5 which is configured in the form of the clamping web and in which it can be displaced in the direction 32 counter to the prestress of the prestressing elements 3 and in the direction 31 in the prestressing direction of the prestressing elements 3, or is displaced by the prestress. It is a linear displacement in the exemplary embodiment which is shown. The arrangement of one of the guide webs 17 in one of the guide web receptacles 26 of the belt fastening element 2 can also be seen clearly in FIG. 10. It can also be seen clearly in the section of FIG. 10 that the guide web receptacles 26 in this section have a cross section 27 which is widened in a wedge-shaped manner in this exemplary embodiment. The cross section 27 of the guide web receptacles 26 is widened in each case in the direction 31 which points away from the region 28 for guiding the belt 35 around the clamping web 5. Moreover, it can be seen clearly in FIGS. 9 and 10 that, in this exemplary embodiment, the guide webs 17 also in each case have, as viewed in section, a cross section 27 which is widened on one side, also in the manner of a wedge here. However, the cross section 27 of the guide webs 17 is widened in the direction 32 which points toward the region 28 for guiding the belt 35 around the clamping web or is tapered precisely in the opposite direction 31. As a result of the cross-sectional widened portions or constrictions of preferably wedge-shaped configuration of the guide webs 17 and the guide web receptacles 26, it is possible to pivot the fastening component 5 in the form of the clamping web onto the belt buckle 1 or onto the belt fastening element 2 in order to mount it on said belt buckle 1 or on said belt fastening element 2. The fastening component 5 preferably latches in at the end of said pivoting movement during mounting in the belt buckle 1 or precisely in the belt fastening element 2 by means of the prestressing elements 3.

Figure 11:
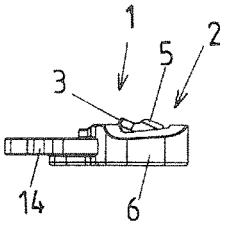
Figure 12:
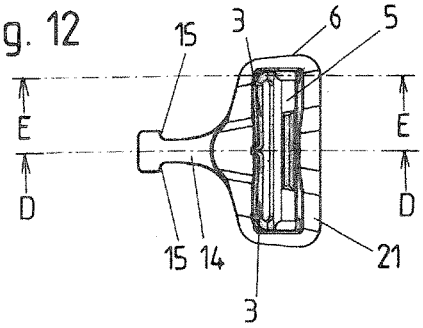
Figure 13:
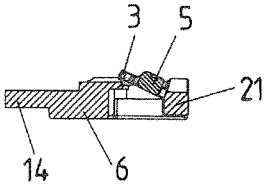

FIG. 11 shows a side view of the male buckle part 6 which is shown here by way of example and an intermediate state during the mounting of the fastening component or clamping web 5 by means of pivoting. FIG. 12 shows a plan view of this state. FIG. 13 shows the section along the sectional line DD and FIG. 14 shows the section along the sectional line EE in the region of a guide web 17 and a guide web receptacle 26. FIGS. 12 to 14 in each case show the same intermediate state during mounting as in FIG. 11. In FIG. 14, the arrow 29 shows the push-in direction, in which the clamping web 5 with its guide webs 17 is first of all pushed obliquely from above into the respective guide web receptacles 26 of the belt fastening element 2 or male buckle part 6. The arrow 30 then shows the pivoting direction, in which the fastening component 5 in the form of the clamping web is then pivoted downward into the finally mounted position. At the end of this pivoting movement, the fastening component 5 then latches with the prestressing elements 3 into a corresponding recess 33. The fastening component 5 is then finally mounted in the belt fastening element 2 or in the belt buckle 1 by means of pivoting, whereby the operating position which is shown in FIG. 10 is reached. In the exemplary embodiment which is shown, this mounting by means of pivoting is made possible by the widening or tapering cross sections 27 which are described of the guide web receptacles 26 and the guide webs 17. As a result of this type of mounting of the fastening component 5, a cross-sectional reduction neither of the clamping web 5 nor of the opposing web 21 is necessary for mounting in the region 28, in which the belt 35 is arranged, with the result that said components can be of relatively solid configuration in this region, without it being necessary to select a particularly heavy or thick outer form of the entire belt buckle 1 for this purpose.

Figure 14A:
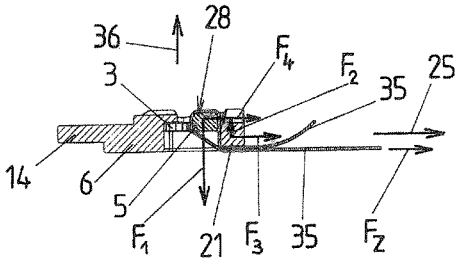
Figure 14:
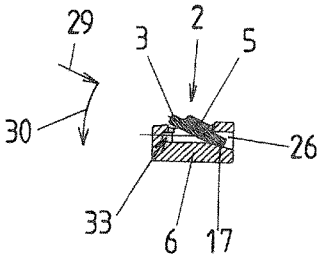

FIG. 14*a* shows a longitudinal section through the male buckle part 6 which is also shown in FIG. 11. However, the fastening component 5 which is configured as a clamping web is mounted in the final state in FIG. 14*a*. Furthermore, FIG. 14*a* also shows the belt 35 which is wound around the clamping web 5 in the region 28 and the corresponding region of the opposing web 21. FIG. 14*a* shows an operating position, in which a tensile force is applied to the belt 35 in the direction $F_Z$ and the clamping web 5 and opposing web 21 clamp the belt 35 fixedly as a result of their interaction.

In the case of a correspondingly powerful tensile force $F_Z$, the forces $F_1$ and $F_4$ act on the clamping web 5 and the forces $F_2$ and $F_3$ act on the opposing web 21, as illustrated in FIG. 14*a*. Above a certain magnitude, all of said forces $F_1$ to $F_4$ can bring about a deformation of the clamping web 5 and opposing web 21, which deformation might lead to loosening or failure of the clamping action of the belt 35 as a result of the interaction of the clamping web 5 and opposing web 21 above a certain degree of deformation. In order to counteract or avoid this, preferred exemplary embodiments of the invention, such as the exemplary embodiment which is shown here, provide that, as a result of the possibility of mounting by means of the above-described lateral pivoting of the clamping web 5 onto the buckle part 6, both the clamping web or fastening component 5 and the opposing web 21 can be of very solid configuration, without this leading to a particularly heavy outer form of the belt buckle 1.

As is shown by way of example in FIG. 14*a*, it can also be provided, however, in preferred exemplary embodiments of the invention, that the clamping web or the fastening component 5 and the opposing web 21 which interacts with it in order to clamp the belt 35 are arranged offset with respect to one another at least in the clamping position, in which they clamp the belt 35 fixedly. Here, the clamping web or the fastening component 5 and the opposing web 21 are favorably arranged offset with respect to one another in a direction 36 orthogonally with respect to the disconnecting direction 25. Here, the clamping web 5 is particularly preferably offset with respect to the opposing web 21 in a direction 36 which points away from the region in which the belt 35 bears against the opposing web 21. As a rule, the tensile force $F_Z$ acts in a direction parallel to the disconnecting direction 25. At any rate, this offset which is shown in FIG. 14*a* achieves a situation where releasing of the clamping action of the belt 35 cannot occur very quickly as a result of deformation of the clamping web 5 in the direction of the force $F_1$ and deformation of the opposing web 21 in the direction of the force $F_2$, as a result of which the load-bearing capability of the buckle is likewise increased, without it being necessary for its external dimensions to be increased to this end.

In order for it to be possible to plug the male buckle part 6 into the female buckle part 7 only in a single position, molded projections of different configuration and corresponding opposing recesses are realized on the female and male buckle parts 7 and 6 in the exemplary embodiments of the belt buckles 1 according to FIGS. 1 to 17 and 19 to 26, which molded projections and recesses together form a plug-in indexing means 19, in that they ensure that the male buckle part 6 can be inserted or pushed into the female buckle part 7 only in a single position.

Figure 5:
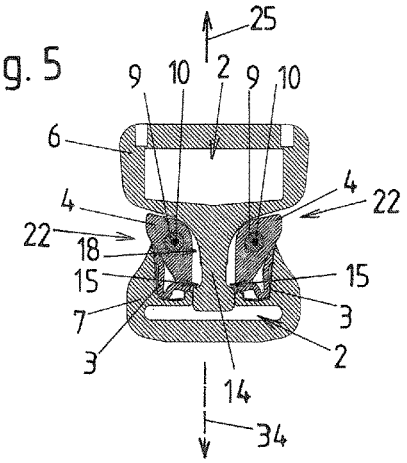

In the locked position which is shown in FIGS. 1 and 2, the fastening components 4 which are configured as locking levers lock the male buckle part 6 in the female buckle part 7. To this end, the push-in anchor 14 has locking shoulders 15 which are engaged behind by the locking levers 4 in the position in which the male buckle part 6 is pushed completely into the female buckle part 7. The prestressing elements 3 which are likewise formed integrally here and are configured as spring tongues press the fastening components 4 which are configured as locking levers into the locked position. If, in the locked position of the locking levers, a tensile force is then applied to one or both of the buckle parts 6 and/or 7 in one of or both disconnecting directions 25 and 34, as they are illustrated in FIGS. 1 and 5, the locking levers 4 are subjected exclusively to a compressive load in these exemplary embodiments. As a result, the locking levers 4 can absorb relatively high forces even in the case of a relatively slim overall design, and can therefore ensure reliable locking. In the exemplary embodiment which is shown, this subjecting to a compressive load is achieved by the fact that the locking shoulders 15 and the pivot pins 8, around which the fastening components or locking levers 4 are mounted pivotably, are arranged in such a way that the locking shoulders 15 can be moved in each case past the respective pivot pin 8 during disconnection of the male buckle part from the female buckle part 7.

Figure 3:
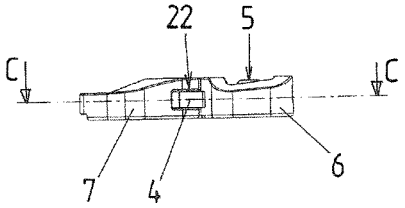
Figure 4:
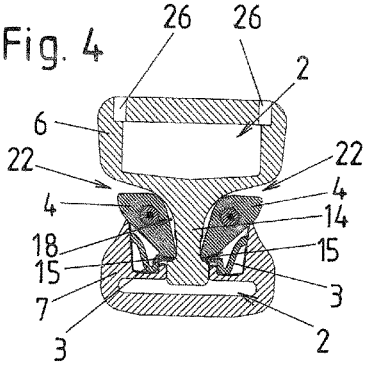

FIG. 3 shows a side view of the belt buckle 1 according to FIGS. 1 and 2 and the sectional line CC. FIGS. 4 and 5 show sections in a sectional plane through the belt buckle 1 which is labeled by the sectional line CC in FIG. 3. In FIG. 4, the push-in anchor 14 and therefore the male buckle part 6 are situated in the locked position. In said position, the two locking levers 4 engage behind the locking shoulders 15 of the push-in anchor 14, with the result that the male buckle part 6 cannot be pulled out of the female buckle part 7. The prestressing elements 3 which are likewise configured as spring tongues here prestress the fastening components 4 in the direction of said locked position.

In order for it to be possible to pull the male buckle part 6 out of the female buckle part 7, a compressive force has to be applied in the intermediate region 22 between the housings of the male and the female buckle part 6 and 7 to those regions of the fastening components 4 which project there. This can be done, for example, using two fingers. As a result, the fastening components 4 are pivoted about their pivot pins 8 counter to the prestress of the prestressing elements 3 until the locking shoulders 15 of the push-in anchor 14 are released. This position is shown in FIG. 5. Here, preferred embodiments of the invention provide that the outer contour of the male buckle part 6 is adapted in the region of the fastening components 4 to the outer contour of the fastening components 4 in such a way that, during pivoting of the fastening components 4 into their release position according to FIG. 5, the male buckle part 6 is automatically pushed at least to a certain extent in its disconnecting direction 25 out of the receiving recess 18 of the female buckle part 7. This prevents the fastening components 4 from latching automatically behind the locking shoulders 15 again when said fastening components 4 are released. In the exemplary embodiment which is shown, it is provided, however preferably, that the two buckle parts 6 and 7 can be disconnected from one another in their respective disconnecting directions 25 and 34 only when all, that is to say here both, fastening components 4 release the push-in anchor 14. If inadvertently not all fastening components 4 are pressed to such an extent that they release the push-in anchor 14 or its locking shoulders 15, the remaining fastening component or components 4 prevents/prevent complete unlocking, with the result that the buckle components 6 and 7 then cannot be disconnected.

Figure 17:
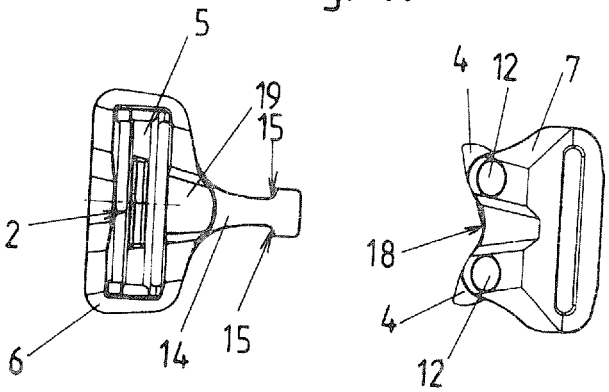

FIG. 17 shows a view of the male and female buckle parts 6 and 7 of the belt buckle 1 of the first exemplary embodiment which are disconnected completely from one another.

Figure 6:
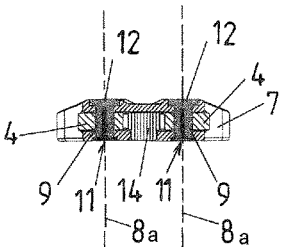

FIG. 6 shows a section through the female and the male buckle part 7 and 6 in the state, in which they are locked together, along the sectional line AA which is illustrated in FIG. 2. Here, the region can be seen particularly clearly, in which the two fastening components 4 are mounted by means of the axle pins 9 such that they can be pivoted about their respective pivot axes 8a.

Figure 15:
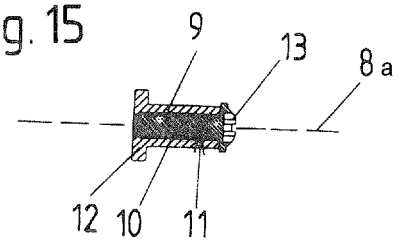
Figure 16:
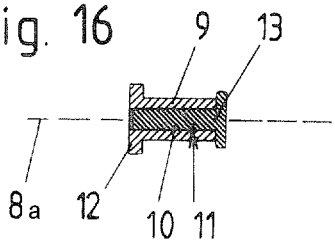
Figure 16A:
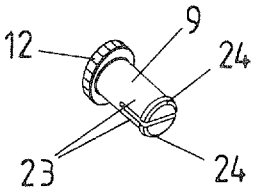

The axle pins 9 which are used in said first exemplary embodiment are shown once again in an enlarged scale in two alternative embodiments in FIGS. 15 and 16. In both variants, they in each case have a receiving recess 11, into which an insertion part 10 can be introduced or else has been introduced in the Figures. In these exemplary embodiments, both the axle pin 9 and the respective insertion part 10 carry heads 12 and 13. The entire axle pin 9 is held on the female buckle part 7 between the head 12 of the axle pin 9 and the head 13 of the insertion part 10. As shown in FIG. 15, the insertion part 10 can be a screw. As an alternative, however, other embodiments are also possible, as shown in FIG. 16, for example. Here, the insertion part 10 is a rivet. As a result of the insertion of the insertion part 10 into the respective recess 11 of the axle pin 9, this recess 11 is stretched a little, with the result that the respective axle pin 9 is held reliably in the respective axle pin receptacle 16 of the female buckle part 7. However, the fastening of the axle pins 9 in the axle pin receptacles 16 can also take place purely by means of the heads 12 and 13 if the insertion part 10 is fastened in a correspondingly fixed manner in the axle pin 9, for example by means of a frictional and/or positively locking connection. FIG. 16*a* shows one more example of an axle pin 9 which can be used as an alternative. This axle pin 9 is of integral or single-piece configuration. In the exemplary embodiment which is shown, it carries spring tongues 23 with latching projections 24. This axle pin 9 latches by means of the latching projections 24 when it is pushed completely into the axle pin receptacle 16, with the result that the axle pin 9 is anchored in the axle pin receptacle 16 by means of its head 12 and its latching projections 24. A further alternative which is not shown here provides a rivet-like single-piece axle pin 9 without spring tongues 23 and latching projections 24.

Figure 7:
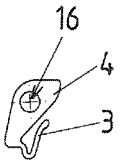

FIG. 7 shows, in a manner which is detached from the other components of the belt buckle 1, the fastening component 4 which is used as a locking lever and on which the prestressing element 3 is arranged integrally according to the invention. Here too, the prestressing element 3 is configured as a flexible spring tongue. The axle pin receptacle 16, through which the axle pin 9 can be guided, is also illustrated in the fastening component 4.

It is conceivable in principle to configure the belt buckle 1 of the first exemplary embodiment from metal, as is usually customary, as is also the case in all other exemplary embodiments which are shown here. Particularly preferred embodiments of the invention provide, however, that it is what is known as a plastic buckle. Here, the entire belt buckle 1 can be produced from plastic. However, it is favorable, in particular, to produce the prestressing element 3 and fastening component 4 and 5, as are shown separately in FIGS. 7, 8 and 9, integrally or as a plastic part. Injection molding represents an inexpensive method for producing the parts here.

Figure 18:
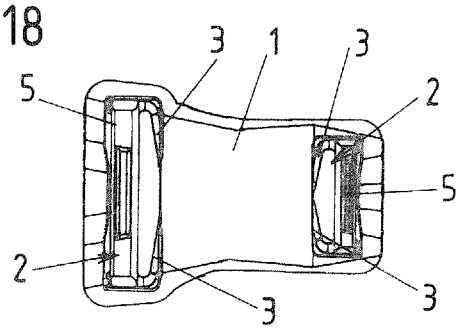
FIG. 18 shows a second embodiment according to the invention of a belt buckle.

FIG. 18 shows by way of example in a second exemplary embodiment of the invention that the belt buckle 1 can also have a single-piece main body, that is to say does not necessarily have to have two buckle parts 6 and 7 which are connected releasably to one another. The main body (shown in FIG. 18) of the belt buckle 1 connects the two belt fastening elements 2 of said second exemplary embodiment according to FIG. 18 integrally. In both belt fastening elements 2, fastening components 5 according to the invention are provided in the form of clamping webs for fastening belts 35 or straps to them. These fastening components 5 of the second exemplary embodiment with their prestressing elements 3 are configured as in the first exemplary embodiment and therefore do not have to be explained in greater detail again. The variant according to FIG. 18 allows two belts 35 or straps of different width to be connected adjustably to one another.

Figure 19:
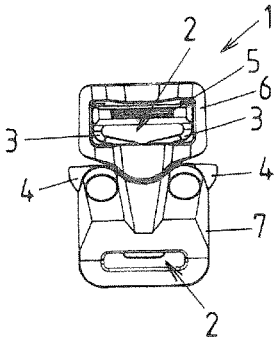
FIGS. 19 to 26 show further embodiments according to the invention of belt buckles which are selected by way of example.
Figure 20:
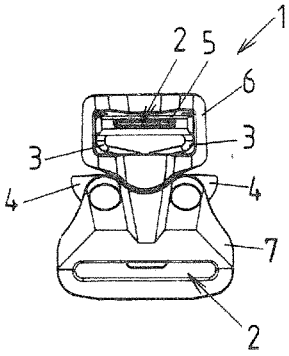
Figure 21:
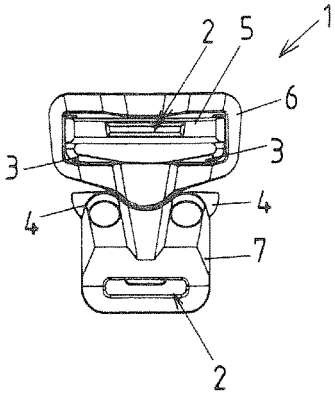
Figure 22:
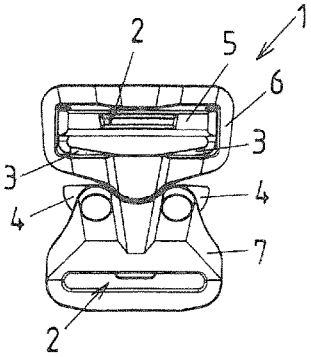
Figure 23:
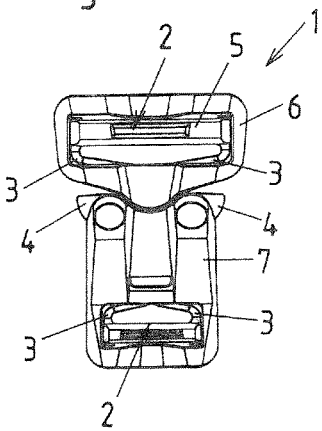
Figure 24:
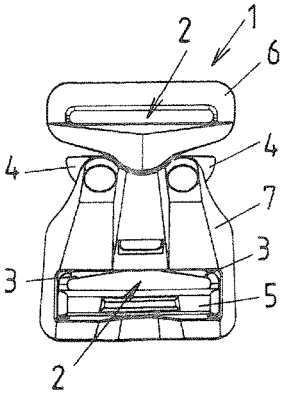
Figure 25:
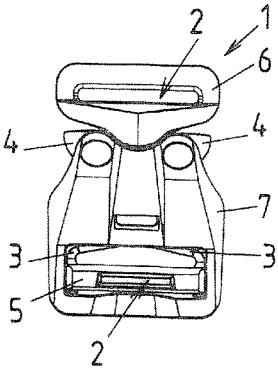
Figure 26:
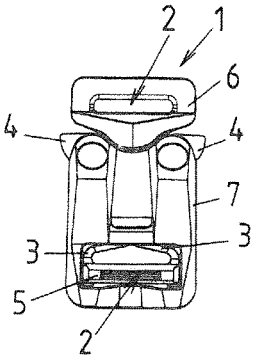

FIGS. 19 to 26 show further exemplary embodiments according to the invention of belt buckles 1. The special feature here, in addition to the fastening components 4 and 5 which are configured according to the invention, is that the male buckle parts 6 of each of said exemplary embodiments can be combined with every female buckle part 7 of the other exemplary embodiments. For example, the embodiments according to FIGS. 19 and 20 form a set with a male buckle part 6 and two female buckle parts 7, the female buckle parts 7 having belt fastening elements 2 of different width from one another for belts 35 of different width from one another and being capable of being locked to the male buckle part 6. The same also applies, in order only to select one further example, to the design variants according to FIGS. 21 and 22. If the design variants according to FIGS. 19 and 21 are taken together, there is a set with a female buckle part 7 and two male buckle parts 6, the male buckle parts 6 having belt fastening elements 2 of different width from one another for belts 35 of different width from one another and being capable of being locked in or on the female buckle part 6. A set of this type is also formed by the belt buckles 1 which are shown in FIGS. 20 and 22. It is clear here that corresponding sets can ultimately consist of as many male and female buckle parts 6 and 7 as desired, as long as there is at least one suitable female buckle part 7 for the male buckle parts 6 and vice versa.

LIST OF DESIGNATIONS

1 Belt buckle
2 Belt fastening element
3 Prestressing element
4 Fastening component
5 Fastening component
6 Male buckle part
7 Female buckle part
8 Pivot pin
8*a* Pivot axis
9 Axle pin
10 Insertion part
11 Recess
12 Head
13 Head
14 Push-in anchor
15 Locking shoulder
16 Axle pin receptacle
17 Guide web
18 Receiving recess
19 Plug-in indexing means
20 Web
21 Opposing web
22 Intermediate clearance
23 Spring tongue
24 Latching projection
25 Disconnecting direction
26 Guide web receptacle
27 Cross section
28 Region
29 Push-in direction
30 Pivoting direction
31 Direction
32 Direction
33 Receptacle
34 Disconnecting direction
35 Belt
36 Direction

The invention claimed is:

1. A belt buckle comprising:

at least one belt fastening element for at least one belt, the at least one belt fastening element including guide web receptacles; and at least one fastening component including:

at least one elastic prestressing element formed integrally thereon;

a clamping web for fixedly clamping the at least one belt, which is adapted to be guided around the clamping web, on the belt buckle; and guide webs;

wherein the at least one fastening component is mounted onto the at least one belt fastening element by introducing the guide webs of the at least one fastening component into the guide web receptacles of the at least one belt fastening element and by subsequently pivoting the at least one fastening component in the guide web receptacles into a final mounted position.

2. The belt buckle as claimed in claim 1, wherein the at least one elastic prestressing element and the at least one fastening component are configured as one continuous plastic part.

3. The belt buckle as claimed in claim 2, wherein the one continuous plastic part is a plastic injection-molded part.

4. The belt buckle as claimed in claim 1, wherein the at least one elastic prestressing element is configured as a spring tongue that protrudes from the at least one fastening component at least in an unloaded state.

5. The belt buckle as claimed in claim 1, wherein the belt buckle comprises plastic or is formed completely thereof.

6. The belt buckle as claimed in claim 1, wherein the belt buckle has at least one male buckle part and at least one female buckle part, the at least one male buckle part and the at least one female buckle part being lockable to and disconnectable from one another using locking levers.

7. The belt buckle as claimed in claim 6, wherein, in a locked position, in which the at least one male buckle part and the at least one female buckle part are locked together, the locking levers are subjected to a compressive load in case of a tensile load in at least one disconnecting direction, in which the at least one male buckle part and the at least one female buckle part can be disconnected from one another.

8. The belt buckle as claimed in claim 6, wherein each of the locking levers is mounted pivotably about a pivot pin and, in a locked position, in which the at least one male buckle part and the at least one female buckle part are locked together, engages behind a locking shoulder of a push-in anchor of the at least one male buckle part, and wherein the locking shoulder is movable past the pivot pin during the disconnection of the at least one male buckle part from the at least one female buckle part.

9. The belt buckle as claimed in claim 1, wherein at least one of the guide web receptacles or the guide webs in each case have, as viewed in a section, a cross section that is widened on one side.

10. The belt buckle as claimed in claim 9, wherein the cross section of the guide web receptacles is widened in a direction that points away from a region for guiding the at least one belt around the clamping web, or the cross section of the guide webs is widened in a direction that points toward the region for guiding the at least one belt around the clamping web.

11. The belt buckle as claimed in claim 9, wherein the cross section is widened on the one side in a wedge-shaped manner.

12. The belt buckle as claimed in claim 1, wherein the guide webs protrude in a freely projecting manner from a region for guiding the at least one belt around the clamping web.

13. The belt buckle as claimed in claim 1, wherein the at least one fastening component is prestressed by the at least one elastic prestressing element in a direction toward a clamped position or a locked position.

14. The belt buckle as claimed in claim 1, wherein the at least one fastening component is pivotably or displaceably mounted.

15. The belt buckle according to claim 1, wherein the at least one elastic prestressing element is pivoted into engagement in a recess in the belt buckle facing the guide web receptacles.

16. The belt buckle according to claim 1, wherein the at least one elastic prestressing element presses the clamping web against a fixed web of the at least one belt fastening element.

17. A belt buckle set comprising:

at least two male buckle parts and at least one female buckle part, each of the at least two male buckle parts being respectively lockable to and disconnectable from the at least one female buckle part using locking levers;

the at least two male buckle parts having respective belt fastening elements of different widths for belts of different widths, each of the respective belt fastening elements including guide web receptacles;

each of the at least two male buckle parts further comprising at least one fastening component, the at least one fastening component including:

at least one elastic prestressing element formed integrally thereon;

a clamping web for fixedly clamping one of the belts, which is adapted to be guided around the clamping web, on the respective male buckle part; and guide webs;

wherein the at least one fastening component is mounted onto the respective belt fastening element by introducing the guide webs of the at least one fastening component into the guide web receptacles of the respective belt fastening element and by subsequently pivoting the at least one fastening component in the guide web receptacles into a final mounted position.

18. A belt buckle set comprising:

at least one male buckle part and at least two female buckle parts, each of the at least two female buckle parts being respectively lockable to and disconnectable from the at least one male buckle part using locking levers;

the at least two female buckle parts having first belt fastening elements of different widths for belts of different widths;

the at least one male buckle part comprising:

at least one second belt fastening element for at least one belt, the at least one second belt fastening element including guide web receptacles; and at least one fastening component including:

at least one elastic prestressing element formed integrally thereon;

a clamping web for fixedly clamping the at least one belt, which is adapted to be guided around the clamping web, on the at least one male buckle part; and guide webs;

wherein the at least one fastening component is mounted onto the at least one second belt fastening element by introducing the guide webs of the at least one fastening component into the guide web receptacles of the at least one second belt fastening element and by subsequently pivoting the at least one fastening component in the guide web receptacles into a final mounted position.

* * * * *